US005875707A

United States Patent [19]

Rajala

[11] Patent Number: 5,875,707

[45] Date of Patent: Mar. 2, 1999

[54] DEWATERING PRESS

[75] Inventor: Hannes Rajala, Seinäjoki, Finland

[73] Assignee: Oy SNE Environment Engineering Ltd., Seinäjoki, Finland

[21] Appl. No.: 875,450

[22] PCT Filed: Jan. 31, 1996

[86] PCT No.: PCT/FI96/00062

§ 371 Date: Aug. 8, 1997

§ 102(e) Date: Aug. 8, 1997

[87] PCT Pub. No.: WO96/23652

PCT Pub. Date: Aug. 8, 1996

[30] Foreign Application Priority Data

Feb. 1, 1995 [FI] Finland ..... 950441

[51] Int. Cl.[6] ..... B30B 9/06

[52] U.S. Cl. ..... 100/37; 100/107; 100/112; 100/116; 100/127

[58] Field of Search ..... 100/37, 107, 110, 100/112, 116, 125, 126, 127, 147, 148, 191, 904, 906

[56] References Cited

U.S. PATENT DOCUMENTS

| | | | |
|---|---|---|---|
| 500,490 | 6/1893 | Grimm | 100/107 |
| 594,297 | 11/1897 | Strattner | 100/107 |
| 825,957 | 7/1906 | Buckley | 100/107 |
| 942,301 | 12/1909 | Wiselogel | 100/107 |
| 4,211,163 | 7/1980 | Brown et al. | 100/148 |
| 5,012,731 | 5/1991 | Maisonneuve . | |

FOREIGN PATENT DOCUMENTS

| | | | |
|---|---|---|---|
| 0268703 | 6/1988 | European Pat. Off. . | |
| 739514 | 1/1933 | France | 100/147 |
| 2023376 | 11/1971 | Germany . | |
| 81263 | 5/1919 | Switzerland | 100/107 |

*Primary Examiner*—Stephen F. Gerrity
*Attorney, Agent, or Firm*—Burns, Doane, Swecker & Mathis, L.L.P.

[57] ABSTRACT

A press for removing water from masses containing materials of organic origin. The press has a compression chamber (2) with a perforated mantle. The discharge end of the compression chamber contains a piston part (3), which is reciprocable in relation to the compression chamber and movable in and out and through which (6) the mass discharges from the compression chamber. The invention is suitable for use, for example, for drying sludges resulting from sewage treatment.

21 Claims, 2 Drawing Sheets

DEWATERING PRESS

TECHNICAL FIELD

Figure 1:
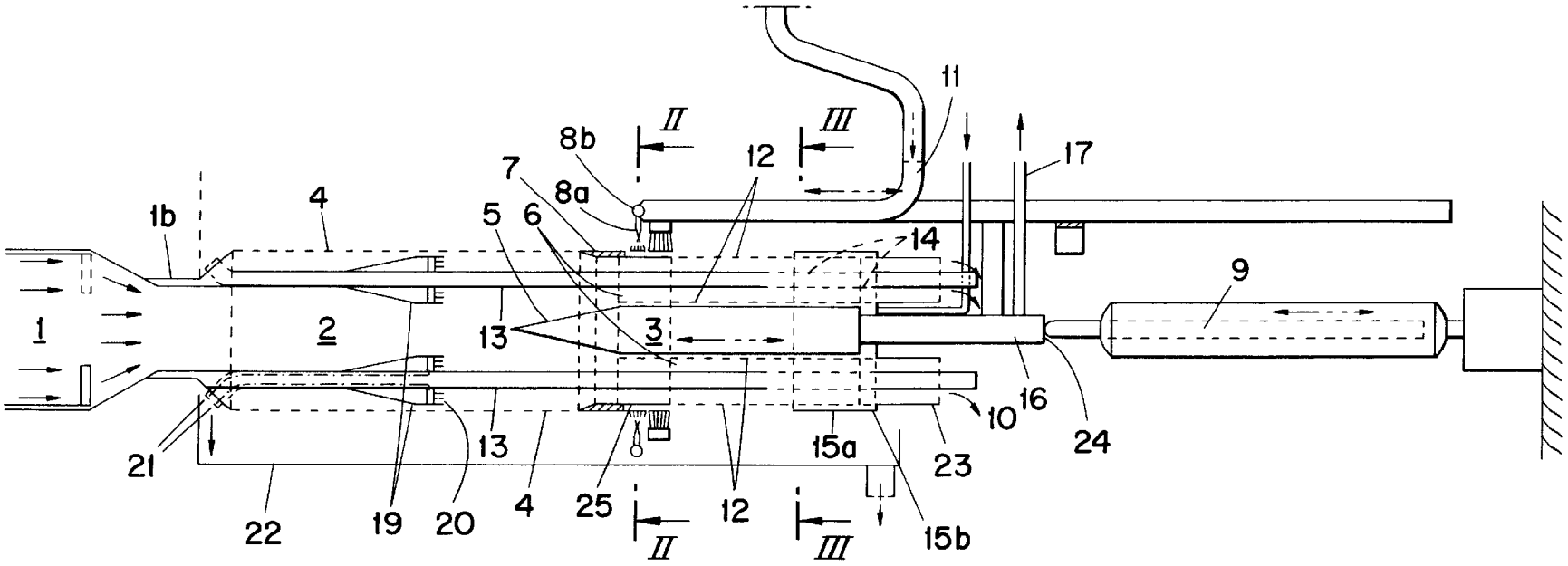

This invention concerns a press for removing water from masses containing materials of organic origin. The invention is suitable for use, for example, for drying sludges resulting from sewage treatment.

TECHNICAL BACKGROUND

Such presses have been used for drying sludges, wherein aqueous sludge is compressed by means of a screw in a cylinder with a perforated mantle. An adjustable gate may be provided at one end of the cylinder in order to create counter-pressure.

Waste which is to be burnt must be made as dry as possible. The dry-matter content even of waste to be composted should be brought to a level of 40–60%. This is often difficult with known equipment and, for example, when treating normal municipal waste it is even impossible to achieve. To raise the dry-matter content to an adequate level, dryer fibrous material, such as dried peat, must usually be added in relatively big quantities as back-up material to sludges.

DESCRIPTION OF THE INVENTION

General description

What is most essential in the invention, is that the mass to be dried is pressed out from a compression chamber provided with a perforated mantle through a piston part which is movable in relation to the chamber.

Using the invention, relatively high dry-matter contents can be achieved without having to use much back-up material. In addition, the final product is compressed into a shape which is advantageous for further treatment.

The movable press part also allows automatic control of the compression pressure, whereby the dry-matter content of the final product can be controlled.

Restarting of the press after an interruption is more reliable than in conventional presses, due to the movable press part. Even partly dried mass is easily put into motion when its static friction is overcome dynamically.

The press is preferably provided with cleaning equipment. This is a particular advantage, especially when e.g. non-homogeneous masses tend to jam the filter openings. The cleaning equipment may be based on the use of brushes or spraying equipment. The cleaning equipment may be movable. In a most advantageous embodiment, the cleaning equipment is movable together with the piston part so that cleaning can be directed to a non-pressurized perforated surface, whereby cleaning is efficient.

Owing to efficient cleaning, smaller filtrate holes and a higher compression pressure may be used than in conventional presses.

In one embodiment, the piston part also rotates during its movement. This helps in the loosening of especially longitudinal particles stuck onto the inner surface of the filtrate mantle. Likewise, the rotational motion helps in the loosening of particles which possibly have remained transversely as blockages in discharge openings of the piston part.

The invention is primarily suitable for use in after-drying of sewage sludge, when the sludge has been predried, for example, in a centrifuge or a filtration band press. Dryer back-up material is mixed with the sludge when required. This may be, for example, fibrous waste or peat. The invention is also suitable, for example, in the forest industry for treating flour waste as such, without predrying with a centrifuge or a filtration band press.

The compressed waste is suitable for utilization, for example, to be burned or composted.

DRAWINGS

In the drawings of the description

Figure 2:
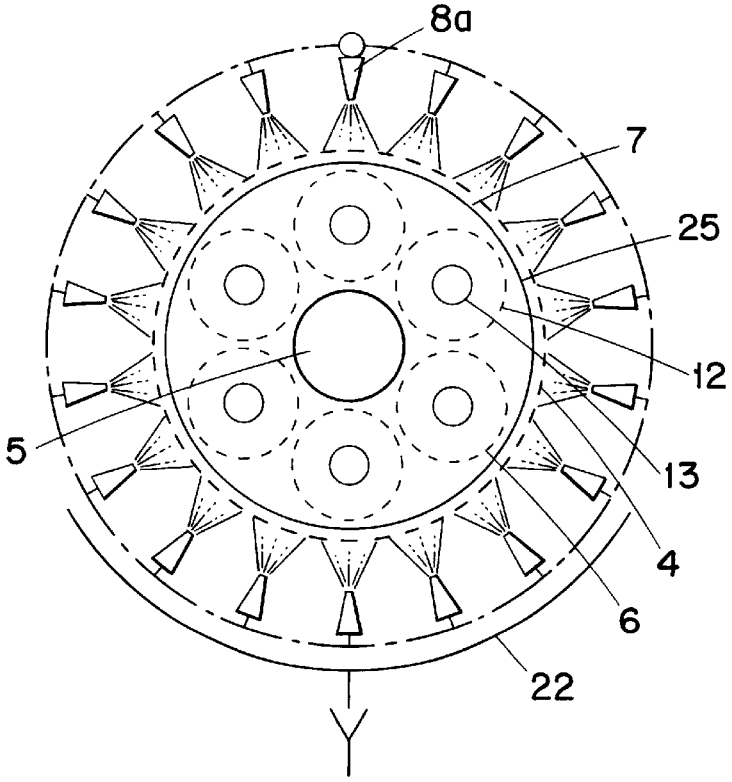
Figure 3:
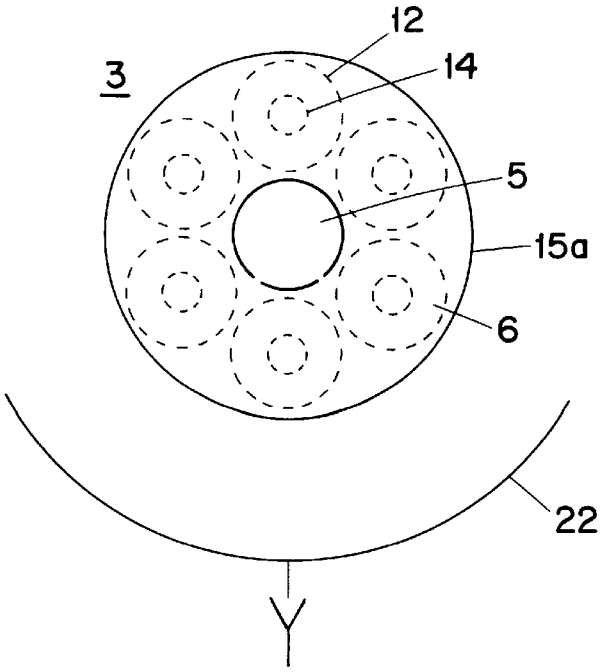

FIG. 1 is a side view of one equipment in accordance with the invention; and FIGS. 2 and 3 are cross-sections of FIG. 1.

EXAMPLE

The press shown in FIG. 1 comprises an feeding part 1, a compression chamber 2 and a piston part 3.

The feeding part 1 has a feeding device, such as a pump or most usually a screw conveyor to move the aqueous mass to be compressed to the inlet end of the compression chamber 2.

The compression chamber 2 is a circular cylinder having a water-permeable but solids-retaining perforated mantle 4. In the chamber, the mass is compressed and water is filtrated out through the holes in the mantle. The perforated mantle is preferably made of wedge-wire mesh.

The piston part 3 has a central rod 5 in the direction of the chamber 2 and six discharge pipes 6 around the rod. The piston part is made movable back and forth at the discharge end of the compression chamber 2. When the piston part is pushed inwards, the mass is further compressed and is pushed into the discharge pipes and further out through their rear ends.

Some mass types are such that they tend to move to the inlet end of the compression chamber 2, when the piston part 3 is pushed into the compression chamber. In equipment for treating such masses, the inlet end may be provided with a device preventing backflow of the mass, such as a closing trap provided with an actuator.

The front ends of the discharge pipes 6 are surrounded by an annular seal 7, which prevents mass from getting into the space between the discharge pipes and the perforated mantle 4. The seal also cuts off and loosens particles caught in the holes of the mantle, and thus it helps in the cleaning of the mantle.

Cleaning equipment movable along with the piston part 3 and provided with nozzles 8*a*, by which water is sprayed onto the outer surface of the perforated mantle 4, is located after the seal 7. In this way, clogged holes are opened. Cleaning is made more efficient by brushes 8*b* connected to the spraying, system.

The reciprocating motion of the piston part 3 is achieved by means of a hydraulic cylinder 9.

The piston part 3 is preferably pushed into the mass by first striking quickly. Thus the static friction of the mass helps in the pushing of the mass into the discharge pipes 6, and the mass will not move in the incoming direction.

The mass discharges from the pipes as sticks or rods 10. These form a loose pile where the mass continues to dry naturally when the moisture content of the air is less than that of the mass. A loose pile is also advantageous for composting, as composting is an aerobic process. It is advantageous for burning and even necessary for composting to achieve moisture contents of 40–60%.

The end of the central rod 5 of the piston part 3 tapers conically. The discharge pipes 6 are mounted around the rod. To promote the flowing of the mass, their ends are shaped together with the central rod and the seal 7. The front edge of the seal is chamfered towards the mantle 4 of the chamber 2. This makes the mass go more easily into the discharge pipes.

For example, at times a detergent may be mixed with the pressure water 11 which is fed into the cleaning equipment 8*a*.

The discharge pipes 6 also have slots 12 through which water is filtered out from the pipes.

The piston part 3 with its discharge pipes 6 creates in the chamber 2 a strong pressure which is applied to the incoming mass, whereby liquid is filtered out from the chamber through the holes in the mantle 4.

Rods 13 are located inside the discharge pipes 6, whereby a cylindrical stick 10 is obtained. The rods are mounted at their front ends to the inlet end 1*b* of the chamber 2.

Filtration of the liquid depends on the water transfer properties of the mass, on the pressure, filtration time and filtration distance. In the discharge pipes 6, the filtration distance is shorter than in the chamber 4. It is made even shorter when water can be removed from the mass sticks from the inside through the rods 13 inside the discharge pipes 6. For this purpose, there is a perforated area 14 in the rods.

The rear ends of the discharge pipes 6 are surrounded by a cylinder 15*a* and the spaces in between are closed in the transverse direction so that it is connected only with the rear end 16 of the central rod. Water 17 may be withdrawn from this hollow space. Another cylinder 15*b* is provided through which desired chemicals, such as polymers, hardening agents or colouring agents may be supplied onto the mass stick surfaces. In this way the properties of the emerging stick may be further modified.

Some masses may be so dry that they perhaps may not discharge properly from the discharge pipes 6. To promote discharging, counter-pistons 19, which extend into the pipes and ensure the pressing of the mass through the discharge pipes, are mounted to the rods 13 at the position of the discharge pipes in the compression chamber 2. For cleaning the discharge pipes, the ends 20 of the counter-pistons are connected to radial spraying equipment to which pressurized air or water can be conducted from the front end 21 of the rod. To ensure the cutting off of the sticks at the desired place as they discharge from the discharge pipes e.g. hot pressurized air or dust may also be conducted through the counter-piston ends into the mass in the discharge pipes, whereby non-homogeneous points are created in the sticks to facilitate breaking.

If desired, chemicals may also be conducted or water withdrawn through the rods 13.

The water discharging from the mass is collected into a trough 22 located below the equipment.

The discharge ends 23 of the discharge pipes 6 are smooth when a smooth stick surface is desired. By shaping the discharge pipes, especially their discharge ends, as well as the end 24 of the central rod, a mass stick with the desired cross-sectional shape is obtained. The cross-sectional area of the sticks may also be enlargened when required, when static counter-pressure is ensured, for example, by lengthening the discharge ends sufficiently.

A cylinder mantle 25 prevents water arriving from the cleaning equipment 8 from getting into the mass.

I claim:

1. A press for removing water from a mass containing aqueous material of organic origin, comprising a compression chamber within a perforated mantle and a discharge end and a feeding part (1) for supplying mass into the compression chamber, a pressing part reciprocable in relation to the compression chamber and located at the discharge end of the compression chamber, the pressing part being provided with at least one opening, wherein the mass discharges from the compression chamber through the pressing part.

2. A press in accordance with claim 1, wherein the pressing part has at least one discharge pipe parallel to a direction of movement of the pressing part.

3. A press in accordance with claim 2, wherein the pressing part has a central rod surrounded by a plurality of discharge pipes.

4. A press in accordance with claim 3, wherein there are holes in a wall of the discharge pipe.

5. A press in accordance with claim 4, wherein a rod is located inside the discharge pipe.

6. A press in accordance with claim 4, wherein a counter-piston extends into a front end of the discharge pipe.

7. A press in accordance with claim 3, wherein a rod is located inside the discharge pipe.

8. A press in accordance with claim 7, wherein a counter-piston extends into a front end of the discharge pipe.

9. A press in accordance with claim 3, wherein a counter-piston extends into a front end of the discharge pipe.

10. A press in accordance with claim 2, wherein there are holes in a wall of the discharge pipe.

11. A press in accordance with claim 10, wherein a rod is located inside the discharge pipe.

12. A press in accordance with claim 10, wherein a counter-piston extends into a front end of the discharge pipe.

13. A press in accordance with claim 2, wherein a rod is located inside the discharge pipe.

14. A press in accordance with claim 13, wherein the rod is a pipe with holes in its wall.

15. A press in accordance with claim 14, wherein a counter-piston extends into a front end of the discharge pipe.

16. A press in accordance with claim 13, wherein a counter-piston extends into a front end of the discharge pipe.

17. A press in accordance with claim 2, wherein a counter-piston extends into a front end of the discharge pipe.

18. A press in accordance with claim 2, wherein the compression chamber includes holes, the press further comprising cleaning equipment for cleaning the holes of the compression chamber.

19. A press in accordance with claim 1, wherein the compression chamber includes holes, the press further comprising cleaning equipment for cleaning the holes of the compression chamber.

20. A press in accordance with claim 19, wherein the cleaning equipment is movable along with the pressing part.

21. A method of removing water by compression from a mass containing aqueous material of organic origin, comprising the steps of feeding the mass into a compression chamber within a perforated mantle, the compression chamber having a discharge end, compressing the mass in the compression chamber with a pressing part that is movable in and out in relation to the compression chamber so that water is removed through the mantle, and removing the mass from the discharge end of the compression chamber through the pressing part.

* * * * *